United States Patent [19]

Muto

[11] Patent Number: 4,941,438

[45] Date of Patent: Jul. 17, 1990

[54] HYDRAULIC VALVE-LASH ADJUSTER

[75] Inventor: Naoto Muto, Kawasaki, Japan

[73] Assignee: Fuji Jukogyo Kabushiki Kaisha, Tokyo, Japan

[21] Appl. No.: 425,802

[22] Filed: Oct. 23, 1989

[30] Foreign Application Priority Data

Oct. 29, 1988 [JP] Japan ..... 63-142186[U]

[51] Int. Cl.[5] ..... F01L 1/24

[52] U.S. Cl. ..... 123/90.46; 123/90.43; 123/90.55

[58] Field of Search ..... 123/90.43, 90.46, 90.48, 123/90.55, 90.57

[56] References Cited

U.S. PATENT DOCUMENTS

| | | | |
|---|---|---|---|
| 3,902,467 | 9/1975 | Cornell | 123/90.46 |
| 4,469,061 | 9/1984 | Ajiki et al. | 123/90.43 |
| 4,498,432 | 2/1985 | Hara et al. | 123/90.43 |
| 4,509,467 | 4/1985 | Arai et al. | 123/90.57 |
| 4,546,734 | 10/1985 | Kodama | 123/90.43 |
| 4,596,213 | 6/1986 | Hillebrand | 123/90.46 |
| 4,840,151 | 6/1989 | Sakata | 123/90.46 |

FOREIGN PATENT DOCUMENTS

| | | | |
|---|---|---|---|
| 0099011 | 6/1984 | Japan | 123/90.46 |
| 59-99012 | 6/1984 | Japan . | |

*Primary Examiner*—David A. Okonsky
*Assistant Examiner*—Weilun Lo
*Attorney, Agent, or Firm*—Martin A. Farber

[57] ABSTRACT

A hydraulic valve-lash adjuster has a cylindrical reservoir case provided in a cylindrical head of an engine, and a cylindrical body secured in the reservoir case. A reservoir chamber is formed between a bottom of the reservoir case and the cylindrical body. A plunger is slidably mounted in the cylindrical body, and a high pressure chamber is formed between a bottom of the cylindrical body and a bottom of the plunger. A pivot is slidably mounted in the reservoir case and a helper spring is provided between the plunger and the pivot.

3 Claims, 2 Drawing Sheets

HYDRAULIC VALVE-LASH ADJUSTER

BACKGROUND OF THE INVENTION

The present invention relates to a valve mechanism for a double overhead camshaft (DOHC) engine with horizontally opposed cylinders, and more particularly to a hydraulic valve-lash adjuster provided in the valve mechanism.

The DOHC engine is provided with a valve mechanism having a rocker arm pivotally mounted on the hydraulic valve-lash adjuster at an end thereof. The rocker arm is rocked by a cam engaged with the rocker arm at a central position thereof. In the horizontally opposed cylinder engine, the intake valve of each cylinder is arranged such that the axis thereof is upwardly inclined and the exhaust valve is disposed in such a manner that the axis of the valve is downwardly inclined. The hydraulic valve-lash adjusters are also inclined in the same direction of the corresponding valves, accordingly.

Japanese Patent Application Laid-Open No. 59-99012 discloses a hydraulic valve-lash adjuster in which a high pressure chamber is provided between a body and a plunger of the hydraulic valve-lash adjuster and a reservoir chamber is formed in the plunger. The reservoir chamber is tapered off toward the high pressure chamber so that bubbles produced in oil in the reservoir chamber may be guided to a remote position from an inlet of a check valve of the high pressure chamber.

In the system, if the hydraulic valve-lash adjuster is horizontally mounted or upwardly inclined, air can be prevented from entering the high pressure chamber due to the tapered reservoir chamber. However, if the hydraulic valve-lash adjuster is downwardly inclined, the high pressure chamber is located on the upper portion of the reservoir chamber and the tapered reservoir chamber is reversed. Consequently, air flows into the high pressure chamber. Accordingly, it is necessary to change the location of the high pressure chamber with respect to the reservoir chamber.

Further, there are other problems. If the clearance between the body and the plunger is large, a large amount of oil leaks from the high pressure chamber and the plunger is unstable in sliding in the body because of lateral force from the rocker arm. In order to resolve the problems, it is preferable to reduce the diameter of the plunger. However, if the diameter of the plunger is reduced, the diameter of a spring becomes small, resulting in reduction of spring force.

On the other hand, during the stop of the engine, oil in the high pressure chamber is leaked. When the engine is started, the plunger is moved by pressurized oil and by the plunger spring to rock the rocker arm through a pivot rod, thereby engaging the end of the rocker arm with the end of the valve stem. However, if the spring force is weak, the engagement of the rocker arm delays. Accordingly, the valve strikes the valve seat, causing noises.

SUMMARY OF THE INVENTION

The object of the present invention is to provide a hydraulic valve-lash adjuster for a valve mechanism which may eliminate above described disadvantages.

According to the present invention, there is provided a hydraulic valve-lash adjuster for a valve of an engine, a valve stem of the valve being inclined with respect to the horizontal, comprising a cylindrical reservoir case provided in a cylinder head of the engine in parallel with the valve stem, a cylindrical body secured in the reservoir case to form a reservoir chamber between a bottom of the reservoir case and an outside of a bottom of the cylindrical body, a plunger slidably mounted in the cylindrical body to form a high pressure chamber between an inside of a bottom of the cylindrical body and a bottom of the plunger, a spring provided in the high pressure chamber so as to push the plunger, a check valve provided in the high pressure chamber so as to keep pressure of oil in the chamber, first passage means for supplying oil to the reservoir chamber and the high pressure chamber.

In an aspect of the invention, second passage means is provided in the cylinder head so as to discharge air in the reservoir chamber.

The other objects and features of this invention will become understood from the following description with reference to the accompanying drawings.

DETAILED DESCRIPTION OF THE PREFERRED EMBODIMENT

Figure 1:
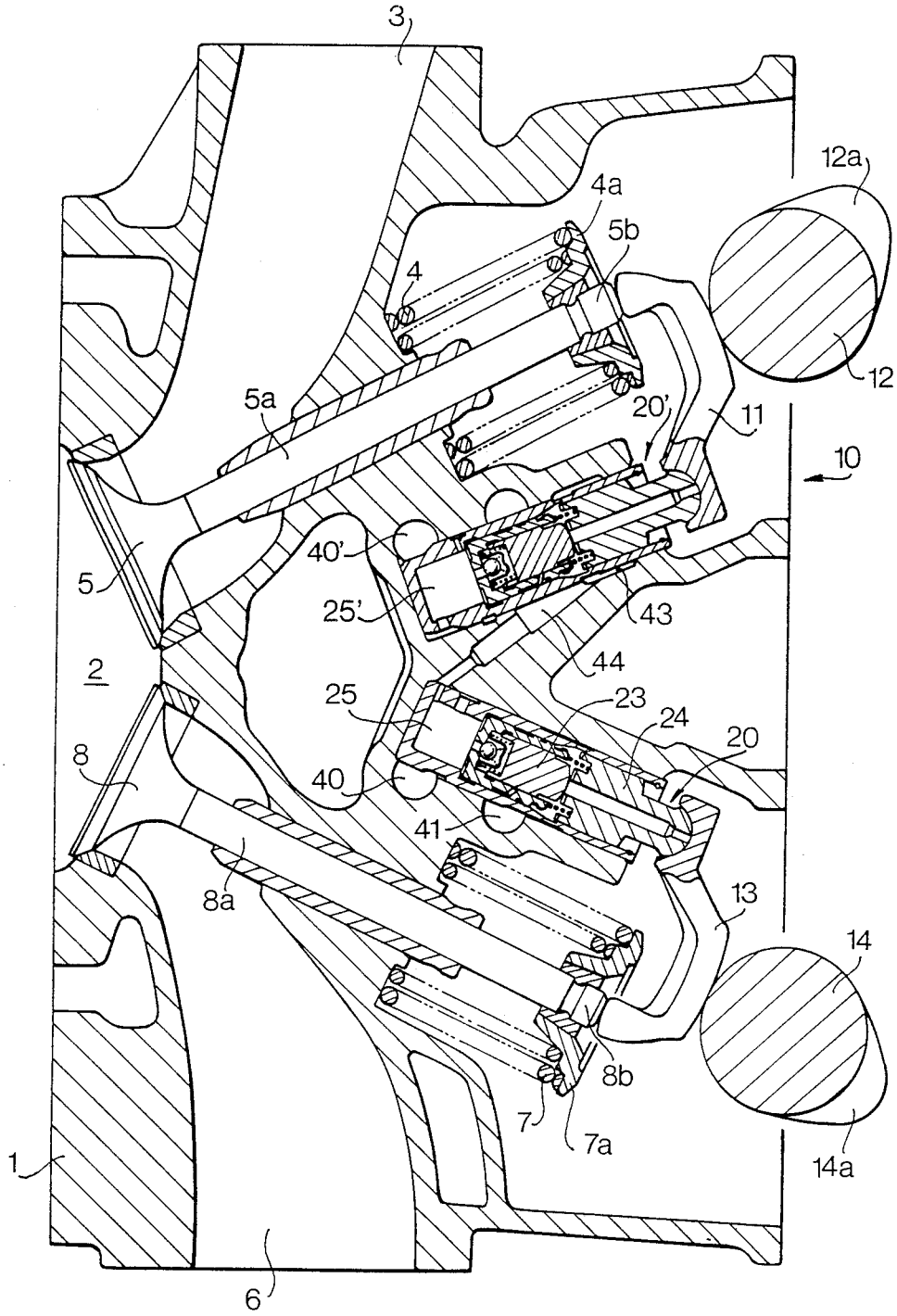
FIG. 1 is a sectional side view showing a valve mechanism for DOHC engine according to the present invention.

Referring to FIG. 1, numeral 1 designates a cylinder head at one of two banks of a horizontally opposed cylinder engine. A combustion chamber 2 of the cylinder communicates with an intake port 3 and an exhaust port 6 formed in the cylinder head. An intake valve 5 is provided to be upwardly inclined with respect to the horizontal. A valve spring 4 is provided between a flat of the cylinder head 1 and a retainer secured to a stem end **5*b*. An exhaust valve 8 provided with a spring 7 is downwardly inclined. A valve mechanism 10 consisting of a double overhead camshaft device is provided for operating both of the intake valve 5 and the exhaust valve 8**.

In the valve mechanism 10, a hydraulic valve-lash adjuster 20' is mounted in the cylinder head 1 in parallel with a valve stem **5*a* of the intake valve 5. A rocker arm 11 supported by the hydraulic valve-lash adjuster 20' engages with the stem end 5*b* of the intake valve 5 and a cam 12*a* integral with a camshaft 12. A hydraulic valve-lash adjuster 20 is mounted in the cylinder head 1 in parallel with a stem 8*a* of the exhaust valve 8. A rocker arm 13 engages with a stem end 8*b* of the exhaust valve 8 and with a cam 14*a* on a camshaft 14**.

The hydraulic valve-lash adjuster 20 for the exhaust valve 8 will be described hereinafter.

Figure 2:
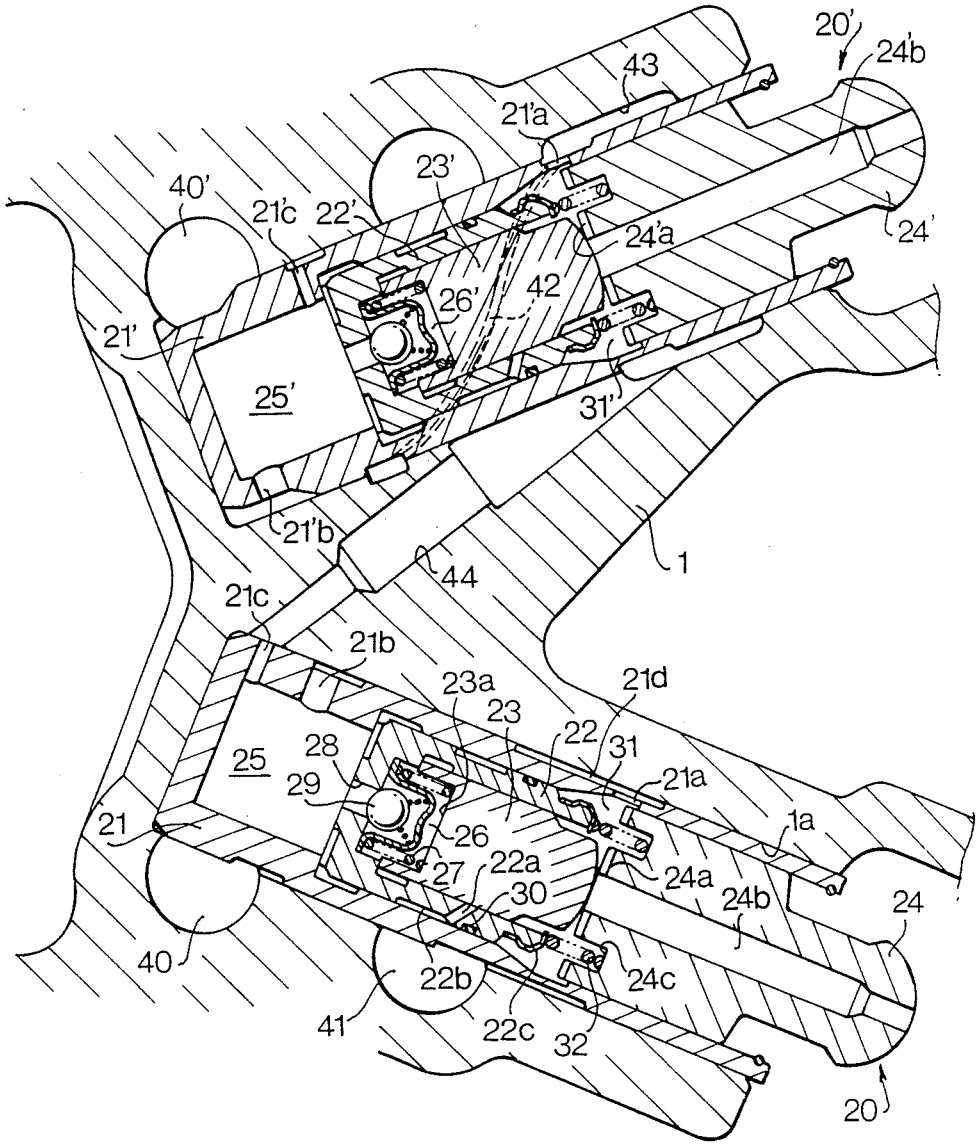
FIG. 2 is an enlarged sectional view showing hydraulic valve-lash adjusters of the valve mechanism.

Referring to FIG. 2, a cylindrical reservoir case 21 having a bottom plate is mounted in a hole **1*a* formed in the cylinder head 1 in force fit engagement. A cylindrical body 22 is mounted in the reservoir case 21 and a bottom of the body 22 is fixed to a middle portion in the reservoir case 21. A solid plunger 23 having a recessed bottom 23*a* is slidably mounted in the body 22. A pivot 24 is slidably mounted in the reservoir case 21 and the innermost portion of the pivot 24 engages with the plunger 23. A reservoir chamber 25 is formed between the bottom plate of the reservoir case 21 and an outside of the bottom of the body 22. A high pressure chamber 26** is formed between an inside of the bottom of the body 22 and the recessed bottom 23*a* of the plunger 23. The bottom of the body 22 has a port 28 which is closed by a ball-check valve 29 provided in the high pressure chamber 26. A coil spring 27 is provided between the recessed bottom 23*a* and the bottom of the body 22.

The body 22 has a port 22*a* radially formed in the cylindrical wall thereof and an annular groove 22*b* circumferantially formed on the outer periphery of the cylindrical wall and communicated with the port 22*a*. An O-ring 30 is provided on the body 22 for sealing the body 22 and the reservoir case 21 so that the oil leaked from the high pressure chamber 26 through the port 22*a* and groove 22*b* is fed back to the reservoir chamber 25. An oil reservoir 31 is formed between the reservoir case 21 and the body 22. The reservoir 31 communicates with a passage 21*a* of the reservoir case 21 and with an axial hole 24*b* formed in the pivot 24 through a groove 24*a* formed on a bottom of the pivot 24. A helper spring 32 is provided in the oil reservoir 31 between the outermost end 22*c* of the body 22 and an annular groove 24*c* formed in the pivot 24 for helping the plunger spring 27.

An oil supply gallery 40, which connected to an oil pump (not shown), is formed in the cylinder head 1 at a bottom portion of the hole 1*a*. The gallery 40 communicates with the reservoir chamber 25 through a passage 21*b* formed in the reservoir case 21. A lubricating gallery 41 is formed in the cylinder head 1 adjacent the passage 21*a* and communicates with the passage 21*a* through an annular groove 21*d* circumferantially formed on the outer periphery of the case 21.

In the hydraulic valve-lash adjuster 20, the reservoir chamber 25 is located higher than the high pressure chamber 26. Accordingly, air in the reservoir chamber 25 stays in the upper corner of the chamber 25 which is most remote from the high pressure chamber 26. A port 21*c* for escaping the air is formed in the upper corner of the case 21.

The hydraulic valve-lash adjuster 20′ for the intake valve 5 is similar to the adjuster 20 in structure. An oil supply gallery 40′ communicates with a reservoir chamber 25′ through a passage 21′*b* of a reservoir case 21′. The reservoir chamber 25′ is located lower than a high pressure chamber 26′. Accordingly, air stays in the upper corner of the chamber 25′ adjacent a bottom of a body 22′, where a port 21′*c* is formed in the reservoir case 21′. The port 21′*c* communicates with a groove 43 formed in the cylinder head 1 through a helical groove 42 formed on the case 21′. The groove 43 further communicates with the port 21*c* of the adjuster 20 through a passage 44. Thus, air stayed in reservoir chambers 25 and 25′ escapes from the groove 43 to the atmosphere. A pivot rod 24′ and the rocker arm 11 are lubricated with oil passing through the passage 44, groove 43, passage 21′*a*, reservoir 31′, groove 24′*a* and axial hole 24′*b*.

The operation of the hydraulic valve-lash adjusters will be described hereinafter. When the engine runs, oil is supplied to the reservoir chamber 25 through the oil supply gallery 40 to fill the chamber 25 with oil and a predetermined amount of oil is applied to the high pressure chamber 26. When the pivot 24 is urged toward the plunger 23 by the cam 14 through the rocker arm 13, oil in the high pressure chamber 26 is pressurized at a high pressure to hold the plunger 23 and the pivot rod 24. Thus, the rocker arm 13 rockes about the pivot 24 to open the exhaust valve 8. When the base circle of the cam 14*a* engages with the rocker arm 13, and the exhaust valve 8 is closed, no load is exerted on the pivot 24. The plunger 23 and the pivot 24 are pushed by pressurized oil in the high pressure chamber 26 and by elastic force of the spring 27 to increase the volume of the chamber 26. Accordingly, the ball-check valve 29 is opened and oil is fed from the reservoir chamber 25 to the high pressure chamber 26 to maintain the engagement of the pivot 24 with the rocker arm 13. The volume of the high pressure chamber 26 varies with the thermal expansion of the exhaust valve 8 to absorb the change of the length of the exhaust valve.

Oil is supplied to the oil reservoir 31 through the lubricating gallery 41 and to the groove 24*a* and the passage 24*b* of the pivot 24 for lubricating sliding portions of the pivot 24 and the rocker arm 13. The oil is further supplied to the space between the reservoir case 21 and the pivot 24 for lubrication. Oil leaked from the high pressure chamber 26 lubricates the plunger 23 and thereafter the oil is fed back to the reservoir chamber 25.

The intake valve 5 is operated in accordance with the hydraulic valve-lash adjuster 20′ in the same manner as the above described operation and the adjuster 20′ is lubricated by the oil supplied to the oil reservoir 31′ through the passage 44. Further, air entering reservoir chambers 25 and 25′ together with oil escapes from the ports 21*c* and 21′*c* and is discharged from the groove 43 through the passage 44 and the groove 42. Thus, air is prevented from entering the high pressure chambers 26 and 26′.

If the exhaust valve 8 is lifted at the time when the engine is stopped, the high pressure chamber 26 of the valve-lash adjuster 20 is compressed to discharge a considerable amount of oil. A small amount of oil in the reservoir chamber 25 leaks together with air. When the engine is started and the base circle of the cam engages with the rocker arm 13, the load exerted on the pivot 24 is removed. Accordingly, pivot 24 and hence the rocker arm 13 are moved by the helper spring 32 before the supply of oil to the high pressure chamber 26, thereby keeping the engagement of the pivot with the rocker arm 13. Since the load exerted on the plunger 23 is removed, the plunger 23 is moved by the spring 27. Thus, oil is supplied to the high pressure chamber 26 to provide the operational state. When the cam 14*a* engages with rocker arm 13, the above described operation starts. Since there is no clearance between the pivot 24 and the rocker arm 13, the exhaust valve 8 is closed without making noise.

When the engine stops under the condition that the base circle of the cam 14*a* engages with the rocker arm 13, no oil in the high pressure chamber 26 leaks. Therefore, oil charged in the high pressure chamber 26 is maintained, thereby preventing the making of noise.

The operation of the hydraulic valve-lash adjuster 20′ is the same as the adjuster 20.

In accordance with the present invention, the hydraulic valve-lash adjuster for the valve mechanism has the reservoir chamber arranged opposite to a plunger interposing a high pressure chamber there-between. Consequently, if the hydraulic valve-lash adjuster is mounted in the cylinder head of the engine to be upwardly inclined, air in the reservoir chamber is prevented from entering the high pressure chamber.

The pivot is separated from the plunger and the helper spring is provided between the pivot and the plunger. Thus, at starting the engine, the hydraulic valve-lash adjuster rapidly responds due to the spring force of the helper spring. Thus, noise made when the valve is seated can be reduced.

While the presently preferred embodiment of the present invention has been shown and described, it is to be understood that this disclosure is for the purpose illustration and that various changes and modifications may be made without departing from the scope of the invention as set forth in the appended claims.

What is claimed is:

1. A hydraulic valve-lash adjuster for an engine with a valve mechanism having at least one valve and one rocker arm, comprising;

a cylindrical reservoir case provided in a cylinder head of the engine;

a cylindrical body secured in the reservoir case to form a reservoir chamber between a bottom of the reservoir case and an outside of a bottom of the cylindrical body;

a plunger slidably mounted in the cylindrical body to form a high pressure chamber between an inside of a bottom of the cylindrical body and a bottom of the plunger;

a spring provided in the high pressure chamber so as to push the plunger;

a check valve provided in the high pressure chamber so as to keep pressure of oil in the high pressure chamber;

a pivot slidably mounted in the reservoir case so as to engage with the rocker arm;

a helper spring provided between the plunger and the pivot; and first passage means for supplying oil to the reservoir chamber and the high pressure chamber.

2. The hydraulic valve-lash adjuster according to claim 1 further comprising second passage means provided in the cylinder head so as to discharge air in the reservoir chamber.

3. The hydraulic valve-lash adjuster according to claim 1 wherein the valve is inclined with respect to the horizontal and the reservoir case is provided in parallel with the valve.

* * * * *